US006080006A

United States Patent [19]

Broder

[11] Patent Number: 6,080,006

[45] Date of Patent: Jun. 27, 2000

[54] INSULATED CONNECTOR FOR ELECTRICAL CONDUCTORS

[76] Inventor: Eric S. Broder, 74 Oneida Ave., Centereach, N.Y. 11720

[21] Appl. No.: 09/318,606

[22] Filed: May 26, 1999

[51] Int. Cl.[7] ..... H01R 4/24

[52] U.S. Cl. ..... 439/409; 439/410

[58] Field of Search ..... 439/409, 417, 439/402, 404, 418, 395

[56] References Cited

U.S. PATENT DOCUMENTS

| | | | |
|---|---|---|---|
| 3,183,472 | 5/1965 | Pawl | 339/97 |
| 3,377,611 | 4/1968 | Pawl | 339/97 |
| 3,920,305 | 11/1975 | Scott | 339/98 |
| 4,192,570 | 3/1980 | Van Horn | 339/98 |
| 4,252,395 | 2/1981 | Ward et al. | 339/97 R |
| 4,420,211 | 12/1983 | Ledbetter | 339/98 |
| 4,448,473 | 5/1984 | Felix et al. | 339/99 R |
| 4,802,869 | 2/1989 | Maue | 439/587 |
| 4,954,098 | 9/1990 | Hollingsworth | 439/404 |
| 4,964,811 | 10/1990 | Hayes, Sr. et al. | 439/398 |
| 5,302,137 | 4/1994 | Suffi | 439/403 |
| 5,417,583 | 5/1995 | Ishizaki et al. | 439/409 |
| 5,820,404 | 10/1998 | Chishima et al. | 439/417 |
| 5,947,761 | 9/1999 | Pepe | 439/409 |

*Primary Examiner*—Gary F. Paumen
*Assistant Examiner*—Alexander Gilman
*Attorney, Agent, or Firm*—Dennison, Scheiner, Schultz & Wakeman

[57] ABSTRACT

The connector includes a cover with wire-receiving bores therein, each bore having a reduced width inner portion for a partial segregation of inserted wires of different sizes and an alignment thereof with slotted blades which are sized to accommodate the segregated wires for electrical contact therewith.

18 Claims, 3 Drawing Sheets

INSULATED CONNECTOR FOR ELECTRICAL CONDUCTORS

BACKGROUND OF THE INVENTION

Electrical connectors or terminal blocks for electrically connecting and retaining two or more electrical wires or insulated conductors have, in recent embodiments, relied on slotted blades of an electrically conductive material which, engage the wires within the blade slots and both short the wires together and lock the wires within the device.

Such devices frequently require the use of a tool, either a conventional tool such as a screwdriver or a specialty tool, to engage the wires within the blade slots to strip the insulation and engage the conductors therein.

The known connectors of this type are basically intended to accommodate, in an optimum manner, wires of the same diameter or gauge with the blade slot displacing or stripping the insulation and making positive and nondestructive contact with the conductors.

The patent to W. F. Pawl, U.S. Pat. No. 3,183,472, discloses wires of different diameters engaged within a single slot. This requires a positive compressing and deforming of the larger diameter conductor. While such a compression of the conductor avoids excessively cutting or notching the larger conductor itself, and thus weakening the conductor, to appropriately compress the conductor would require that the connector plate be of a substantial thickness, and that substantial force, utilizing a specialty tool, is necessary to properly strip and seat the conductors.

SUMMARY OF THE INVENTION

The connector of the invention, has, as its primary object, the provision of a tool-free system for electrically connecting or shorting together of insulated conductors of two different sizes or gauges. In doing so, the connector of the invention strips or cuts through the insulation of each conductor in accord with the size of the particular wire and in a manner which provides for the necessary shorting contact with the conductor itself without distortion of the conductor or excessive cutting into the conductor body.

Basically, the wires or insulated conductors are positioned within bores defined longitudinally within the cover of the connector with the interior of each bore being selectively reduced in width to accommodate the lower gauge wire only within the outer extent or portion of each bore while the higher gauge wire will pass freely through the outer portion of the bore and into and along the corresponding inner portion of the bore. In this manner, the different gauge wires are in effect segregated in a single bore. A pair of grooves extend transversely across each bore, one generally centrally of the outer portion thereof and the other generally centrally of the inner portion thereof. These grooves or channels, upon a closing of the cover over the base of the connector, individually receive separate contact blades of an electrically conductive contact plate embedded within the base. The contact blades each include vertically extending, insulation stripping, slots therein aligned with the corresponding portions of the bores. Thus, as the cover, with wires therein, is closed over the base, the blades engage upward through the channels with the wires within the bore portions forced within the slots of the corresponding blades for a stripping or cutting of the insulation therefrom and an engagement with the conductors themselves.

The blade slots aligned with the front portions of the bores are of a width to accommodate the larger wires for an appropriate cutting of the insulation therefrom. The smaller size wires will pass freely through the slots associated with the forward portions of the bores.

The stripping slots aligned with the rear portions of the bores will be narrower than the width of the aligned slots forward thereof and will be so dimensioned as to effectively strip the insulation from the smaller wire as it is extended into the rear portions of the bores to achieve electrically conductive contact with the conductor. In each instance, the blade slot is dimensioned or sized to engage a specific gauge wire aligned therewith notwithstanding the introduction of wires of different gauge within a common bore.

Multiple duplicate bores and corresponding blade slots can be provided as required. For example, in the illustrated embodiment, the connector is intended to accept up to eight solid conductors of 22 and 24 gauge copper insulated telephone leads. The connector will strip the insulation and short all of the eight leads together on the internal contact plate utilizing the contact blades formed therefrom.

Other objects and features of the invention will be become apparent from the following more detailed description of the invention.

DESCRIPTION OF PREFERRED EMBODIMENTS

Figure 1:
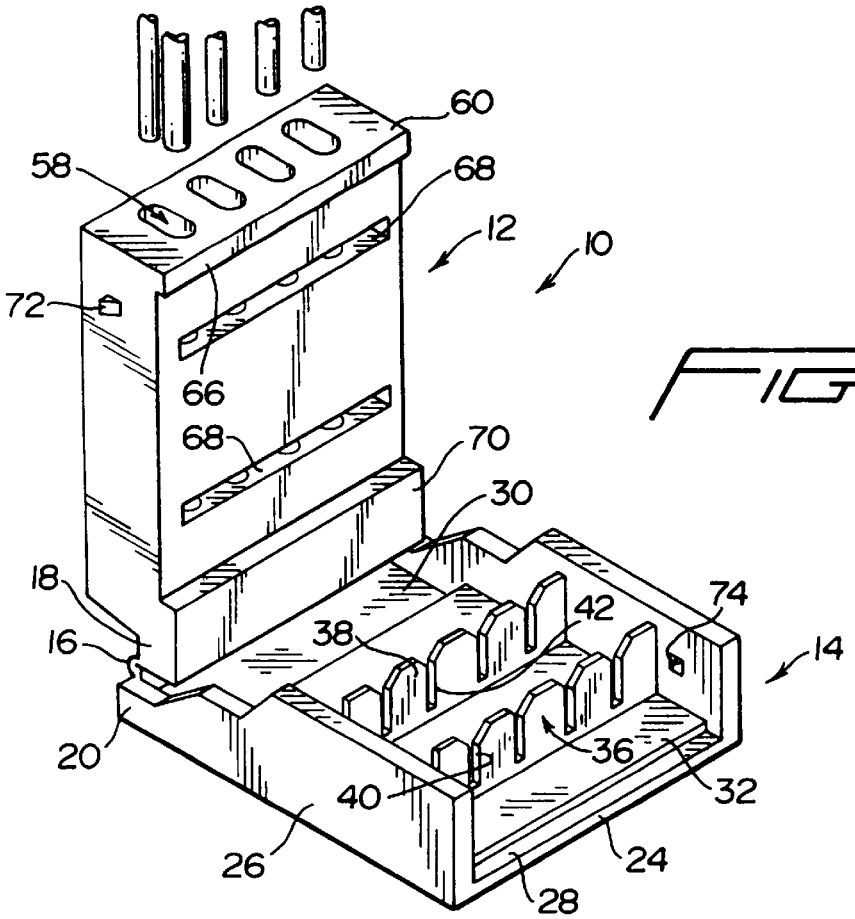
FIG. 1 is a perspective view of the connector with the cover open and the wires aligned for introduction.

Referring now more specifically to the drawings, the connector 10, formed of an insulating synthetic resinous body, consists basically of two components, a cover 12 and a base 14. The cover and base are preferably molded as a single unit with the cover 12 integrally joined to the base 14 by a living hinge 16 extending along the full length of the aligned rear or back edges 18 and 20 of the cover and base respectively.

The connector 10, as illustrated, is particularly intended as a connector for up to eight solid conductor 22 and 24 gauge copper insulated telephone leads, and will be described as such.

The base 14 is preferably of a rectangular configuration with a bottom 22 extending from the rear edge 20 to a front edge 24. Opposed vertical side walls 26 extend upward from the side edges of the bottom 22 to guide and laterally confine the cover 12 as the cover is closed over the base. The upper surface of the bottom 22 of the base 14 includes transversely extending forward and rear recesses 28 and 30 therein with the central section 32 between the recesses 28 and 30 being of a relatively greater thickness to accommodate the wire stripping and shorting contact plate 34.

Figure 4:
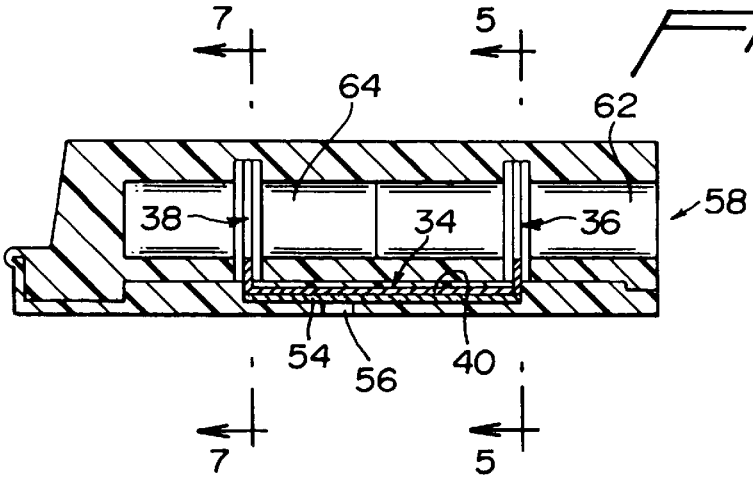
FIG. 4 is a longitudinal cross-sectional view through the connector with the wires removed for purposes of illustration.
Figure 5:
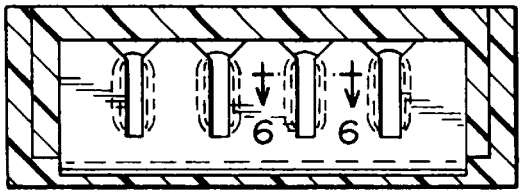
FIG. 5 is a transverse cross-sectional view taken substantially on a plane passing along line 5—5 in FIG. 4.
Figure 7:
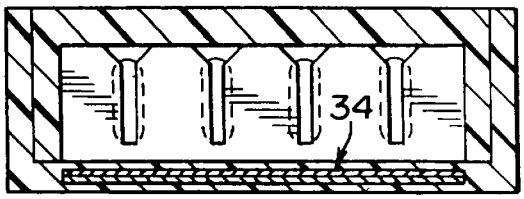
FIG. 7 is a transverse cross-sectional view through the connector taken substantially on a plane passing along line 7—7 in FIG. 4.
Figure 8:
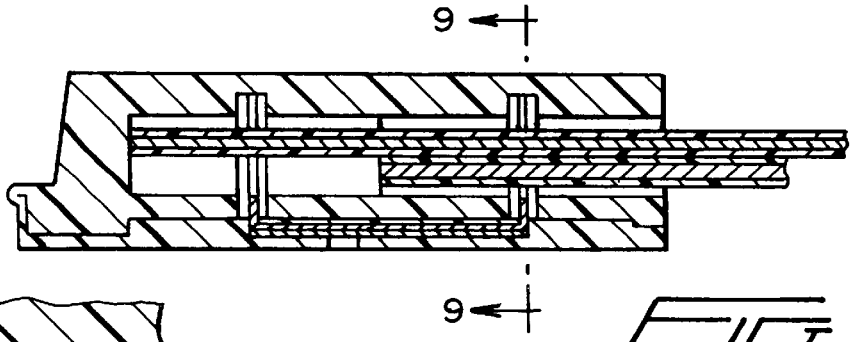
FIG. 8 is a longitudinal cross-sectional view similar to FIG. 4 with the wires positioned within the connector.
Figure 10:
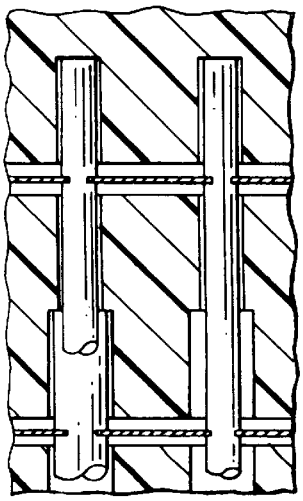
FIG. 10 is cross-sectional detail substantially on a plane passing along line 10—10 in FIG. 9.

Noting FIGS. 4 and 7 in particular, the contact plate 34 is of an appropriate electrically conductive material of a width as to extend transversely across the bottom between the opposed side walls 26. The plate 34 has the opposed edge portions thereof upwardly folded to define front and rear contact blades 36 and 38 in spaced parallel relation to each other. The central section 39 of the contact plate 34 between the blades 36 and 38 is completely embedded within the relatively thicker portion 32 of the bottom 22 with the blades 36 and 38 extending upwardly from the bottom panel 22 to an exposed height only slightly less than that of the opposed side walls 26.

Figure 6:
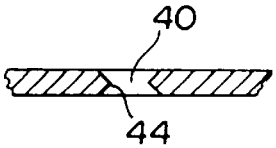
FIG. 6 is an enlarged cross-sectional detail taken substantially on a plane passing along line 6—6 in FIG. 5.

Each of the contact blades 36 and 38 has a series, preferably four, of vertical stripping slots therein. The slots in the front blade 36 being designated by reference numeral 40 with the slots in the rear blade 38 designated by reference numeral 42. Each of the slots is of a constant width for the height thereof, other than for a outwardly flaring upper or mouth end which assists in inwardly guiding the insulated wires into the appropriate slots as shall be described subsequently. FIG. 6, while a sectional detail through a front slot 40, illustrates a cross-section typical of both sets of slots wherein vertical knife edges 44 define the opposed vertical edges of the slots and are specifically configured as to effectively pierce the insulation to both sides of the central wire conductor and make a shorting contact with the internal conductor.

Figure 9:
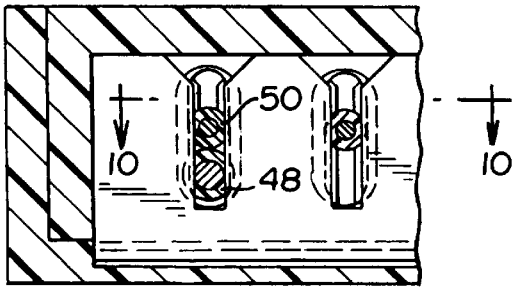
FIG. 9 is a partial cross-sectional detail taken adjacent one side of the connector and on a plane passing substantially along line 9—9 in FIG. 8.
Figure 11:
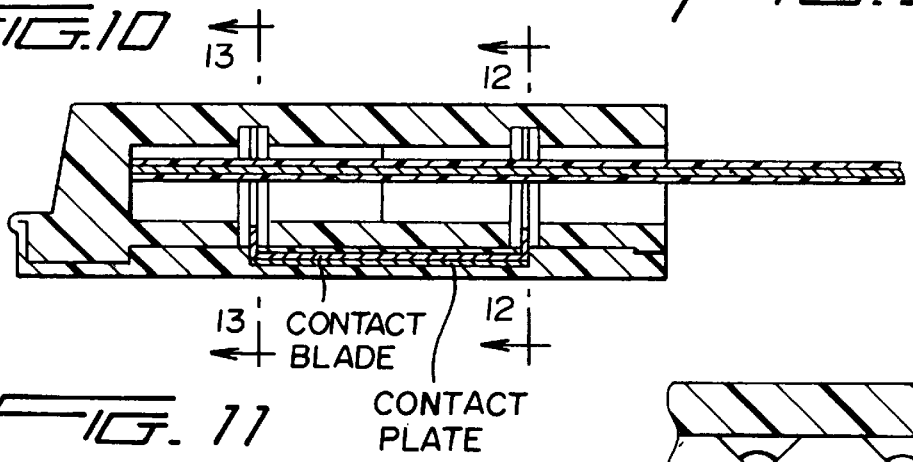
FIG. 11 is a longitudinal cross-section taken substantially on a plane passing along line 11—11 in FIG. 3 and illustrating an internally positioned smaller diameter wire.

The front blade slots 40 are wider than the rear blade slots 42 and are intended to conductively engage with a larger diameter inserted wire 48, for example 22 gauge, forcibly received therein, while allowing for substantially free passage of the proposed smaller diameter wire 50, for example 24 gauge. This relationship of the wires 48 and 50 to the front slots 40 will possibly be best appreciated from FIG. 9.

Figure 13:
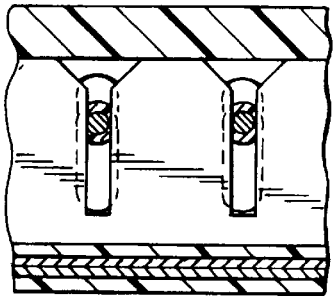
FIG. 13 is a cross-sectional detail taken substantially on a plane passing along line 13—13 in FIG. 11.
Figure 12:
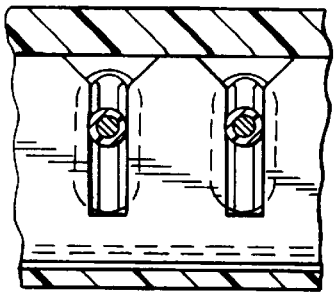
FIG. 12 is a cross-sectional detail taken substantially on a plane passing along line 12—12 in FIG. 11.

The smaller width rear blade slots 42, from which the larger diameter wire is excluded as shall be described subsequently, in turn are sized as to receive the smaller diameter wire 50, sever or strip the insulation thereon, and make effective and non-damaging engagement with the conductor, note for example FIG. 13.

Figure 3:
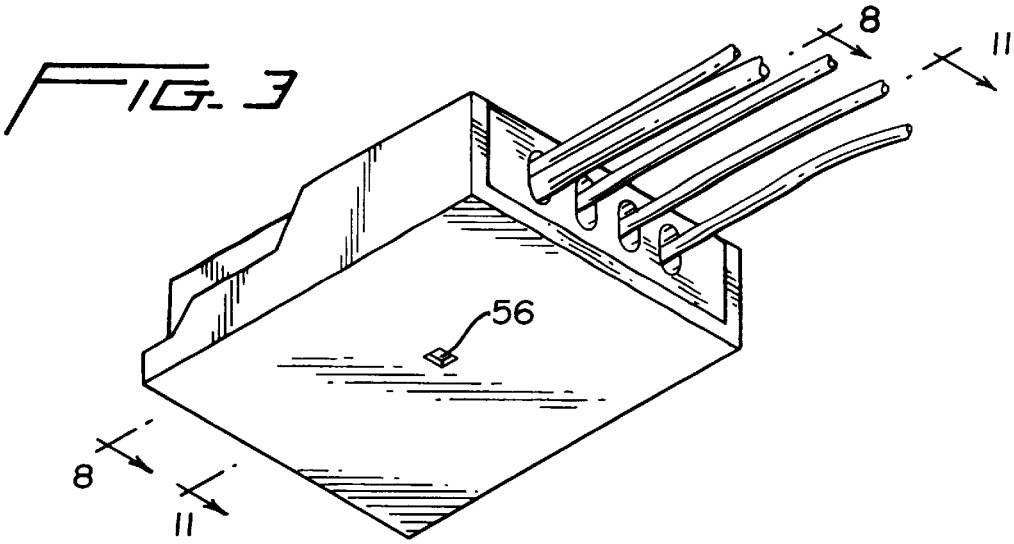
FIG. 3 is a perspective view of the connector with the cover closed and the wires inserted and grasped therein.

As desired, an additional ground plate 54, coextensive with the intermediate portion 39 of the contact plate 34 can be provided immediately therebelow and in direct contact therewith. Further, and noting FIGS. 3 and 4 in particular, an aperture 56 is provided through the base bottom 22 allowing direct access to the ground and/or contact plates allowing for the use of a continuity meter between the plates and the inserted wires to confirm that all of the wires have been properly shorted together, that is no measurable electrical resistance exists between the plurality of leads.

The cover 12, which is preferably in the form a solid block, provides the dual function of receiving and properly positioning the wires or leads for engagement within the blade slots, and as a protective locked closure for the shorted components.

Structurally, the cover includes a plurality of bores 58, preferably four, extending longitudinally inward through the front edge or face 60 of the cover and for a major portion of the front to rear length thereof. The bores 58 are vertically elongate, that is of a substantially greater height than width to allow for the convenient accommodation of stacked wires, note for example the two different gauge or size wires received within the left hand bore in FIGS. 1–3.

Each bore, while of a constant height throughout the length thereof, includes a front portion 62 of a greater transverse width and a rear portion 64 of a lesser width. The portions are each approximately one-half the length of the bore 58. The front portion 62 is sized to accommodate the larger diameter wire 48, for example 22 gauge wire. The rear portion 64 is sized to preclude entry therein of the larger wire which will abut against the leading face of the inner bore portion 64, while allowing for insertion of the smaller diameter wire, for example a 24 gauge wire, the inserted inner end thereof abutting against the inner end of the bore.

Access to the interior of the bores 58, and hence the wires received therein, by the contact blades 36 and 38 is provided for by front and rear access channels 66 and 68. These channels 66 and 68 extend transversely across the cover 12 and are defined inward through the underface of the cover in respective alignment with the front and rear bore portions generally centrally of each portion. The channels, noting the various cross-sectional details, extend to a point slightly above the bores to allow for a full accommodation of the contact blades with the wires within the bores. As will be appreciated, the number and spacing of the bores corresponds exactly to the number and spacing of the blade slots.

In use, the wires to be shorted, anywhere from to two to eight wires, are inserted into the bores 58 of the open cover 12 and, depending upon the wire sizes, extending either for the full length of the bores or only within the front portions thereof. The cover 12 is then closed over the base with the blades 36 and 38 being received respectively in the front and rear channels 66 and 68. With a slight downward pressure on the cover, the wires enter into the blade slots and are stripped by the opposed cutting edges 44 of the slots 40 and 42 so as to both grasp the individual wires and effectively electrically engage the wire conductors. As will be appreciated, the smaller size wires, that is those wires which extend the full length of the bores, will pass freely through the wider front blade slots 40 and will be stripped by the narrower rear blade slots 42. The stripping of the larger diameter wire within the wider stripping slots 40 ensures that the insulation is properly stripped and effective contact made with the conductor without excess cutting into the conductor itself as might affect the structural integrity thereof.

Figure 2:
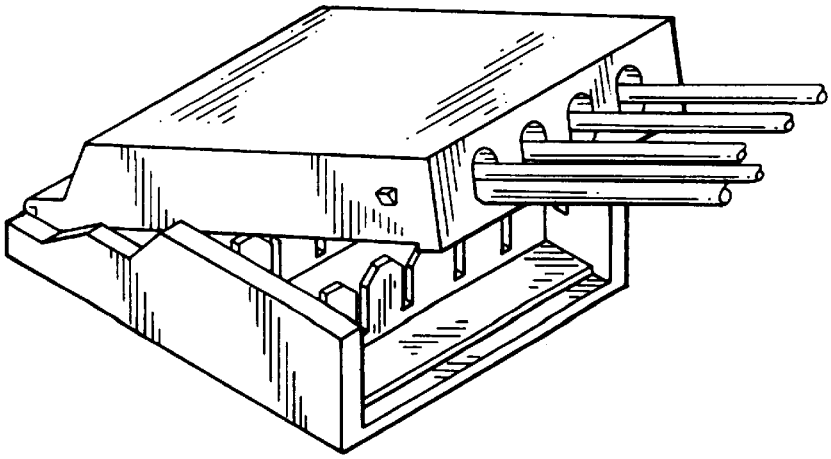
FIG. 2 is a perspective view with the wires inserted and the cover partially closed.

Noting FIGS. 1 and 2 in particular, the undersurface of the cover 12 is provided with transversely extending depending front and rear projections 69 and 70 which are received within and closely conformed to the upwardly directed front and rear recesses 28 and 30 defined in the upper surface of the base bottom 22, thus providing for an intimate and protected closing between the cover and the base. As will be appreciated, the cover 12 is slightly narrower than the base and is received in a close-fitting nested relationship between the opposed side walls 26. It is intended that the cover, which carries and supports the wires, be locked to the base in its closed positioned. Pursuant thereto, a pair of camming lugs 72 are formed on the opposed side edges of the cover toward the front 60 thereof, these lugs engaging within the appropriate recesses 74 defined in the opposed inner faces of the base side walls 26 just forward of the front blade 36.

The opposed side walls 26, for a major portion of the length thereof rearward from the front of the connector, are of equal height with the closed cover therebetween. Toward the rear of the connector, the side walls 26 are stepped downward to facilitate a rapid unencumbered snap closing of the cover. While the cover 12 has been illustrated as integrally molded with the base 14 with a living hinge 16 defined therebetween, should it be preferred, as a molding expedient, the cover can be separately formed and directlySucapped downward into the base. Such a procedure might also require a additional locking cams toward the rear of the cover and base.

While the connector of the invention, as described, is uniquely adapted to accommodate wires of two different sizes, it is also appreciated that the connector can be used to short or electrically connect multiple wires of the same size. For example two to eight 22 gauge wires, all of which will be accommodated in the front portion 62 of the bores 58.

The foregoing is illustrative of a preferred embodiment of the invention. However, it is to be appreciated that the invention is not to be taken as limited to all of the details thereof as modifications and variations thereof may be made without departing from the spirit or scope of the invention.

What is claimed is:

1. An electrical connector for shorting together first and second insulated wires of different sizes, said connector including a non-conductive base and a non-conductive cover, said base being opened upwardly and including a bottom, a front, a back and opposed sides, said cover being closed downwardly over said base, an electrically conductive contact plate mounted in said base, said contact plate having a forward contact blade and a rear contact blade spaced from each other and extending upwardly from said bottom, each of said blades having an upwardly opening stripping slot therein for receiving and stripping insulation from an insulated wire, said slots in said blades being aligned from said front to said back, said slot in said rear blade having narrower width than the width of the slot of said forward blade, whereby the first insulated wire of a first width to be engaged by said slot of said forward blade, and said second insulated wire having a second width which is narrower than the first width to be passed through said slot of said forward blade and be engaged with said rear blade slot, said cover including bore means and a pair of access openings to receive said blades, said bore means having a first portion of a first width and a second portion of a second width narrower than said first width for receiving and positioning the first and second insulated wires of different sizes therein corresponding to the width s of the stripping slots for alignment of insulated wires with the corresponding slots for the stripping of insulation therefrom as said cover is closed over said base.

2. The connector of claim 1 wherein multiple wire-receiving bores are provided in said cover, each of said blades including a number of slots corresponding to the number of bores and positioned for alignment and engagement within said bores upon a closing of the cover over the base.

3. The connector of claim 2 wherein said base includes opposed side walls, said cover, upon closing over said base, being closely received between said base side walls.

4. The connector of claim 3 wherein each of said slots is defined by opposed knife edges vertically therealong, each slot having a flared mouth at the open upper end thereof.

5. The connector of claim 4 wherein said bores are vertically elongate for the accommodation of multiple wires within each bore.

6. The connector of claim 2 wherein said bores are vertically elongate for the accommodation of multiple wires within each bore.

7. The connector of claim 6 wherein each of said slots is defined by opposed knife edges vertically therealong, each slot having a flared mouth at the open upper end thereof.

8. The connector of claim 7 wherein said channels, and said blades when received therein, are of a height so as to vertically traverse said bore portions and extend upwardly there beyond.

9. An electrical connector for shorting together of first and second insulated wires of different sizes, said connector including a non-conductive base and a non-conductive cover, said base being opened upwardly and including a bottom, a front, a back and opposed sides, said cover being closed downwardly over said base, an electrically conductive contact plate mounted in said base, said contact plate having a forward contact blade and a rear contact blade spaced from each other and extending upwardly from said bottom, each of said blades having an upwardly opening stripping slot therein for receiving and stripping insulation from an insulated wire, said slots in said blades being aligned from said front to said back, said slot in said rear blade having narrower width than the width of the slot of said forward blade, said cover having a front and back corresponding to the front and back of said base, a plurality of bores for receiving and positioning insulated wires each of said bores extending rearwardly in said cover from an open end at the front of the cover, said bore having a first portion of the first width and a second portion extending rearwardly from said first portion, said second portion having a second lesser width, said cover having a bottom face with a pair of blade receiving channels through said bottom face, each channel communicating with one of said first and second bore pore portions, whereby, upon a closing of the cover, the blades engaged through said channels and into the respective bore portion to strip and grasp wires positioned therein.

10. The connector of claim 9 including an aperture extending into said base bottom and communicating with said contact plate whereby a minor portion of the plate is accessible in the closed connector for continuity testing.

11. An electrical connector for shorting together insulated wire of two different sizes, said connector comprising a first insulated wire-receiving and positioning component and a second insulated shorting component, said first component having multiple laterally spaced bores therein, each bore having an end opening a first outer portion inward from said end opening having a first width, and a second inner portion inward of said first outer portion and having a width less than said first width, a pair of access openings in said first component extending transversely across and opening into said bores, one of said access openings being aligned across said first portions of said bores, and one of said access openings being aligned across said second portions of said bores, said second component including a conductive plate with first and second contact blades thereon alignable with said access openings for selective insertion of said blades into said bores transversely across said first and second bore portions, each of said blades having outwardly opened stripping slots therein aligned with and received in said bores for the reception of bore-received wires therein, said slots in said first blade having a first width and the slots in said second blade having a second lesser width.

12. The connector of claim 11 wherein said bores are vertically elongate for the accommodation of multiple wires within each bore.

13. The connector of claim 11 wherein said first and second components respectively comprise a cover and a base integrally formed with a living hinge defined therebetween for selected closure of said cover over said base.

14. The connector of claim 13 wherein said base includes a bottom, said conductive plate being embedded within said bottom, said contact blades being integral with said conductive plate and projecting upward from said bottom.

15. The connector of claim 14 wherein said bores are vertically elongate for the accommodation of multiple wires within each bore.

16. The connector of claim 15 wherein said access openings, and said blades when received therein, are of a height so as to vertically traverse said bore portions and extend upwardly there beyond.

17. The connector of claim 16 wherein said base includes opposed side walls, said cover, upon closing over said base, being closely received between said base side walls.

18. The connector of claim 17 wherein each of said slots is defined by opposed knife edges therealong, each slot having a flared mouth at the open end thereof.

* * * * *